US006817796B1

(12) United States Patent
Hurd

(10) Patent No.: US 6,817,796 B1
(45) Date of Patent: Nov. 16, 2004

(54) SHAFT LOCK DEVICE AND METHOD

(75) Inventor: Bruce E. Hurd, Monroe, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/701,738

(22) Filed: Nov. 5, 2003

(51) Int. Cl.[7] ..... B41J 29/56; B41J 29/54

(52) U.S. Cl. ..... 400/668; 400/354; 400/355; 101/47

(58) Field of Search ..... 400/140, 352, 400/354, 355, 357, 668, 701, 59; 101/47, 57, 84, 485, 486, 394, 391

(56) References Cited

U.S. PATENT DOCUMENTS 2,918,867 A * 12/1959 Killary et al. ..... 101/375
4,277,189 A * 7/1981 Howard et al. ..... 400/320
4,773,773 A * 9/1988 Itoh ..... 400/59

* cited by examiner

*Primary Examiner*—Leslie J. Evanisko
(74) *Attorney, Agent, or Firm*—Michael J. Cummings; Charles R. Malandra, Jr.; Angelo N. Chaclas

(57) ABSTRACT

A method and device for locking and unlocking a print head assembly along a shaft in an addressing machine. The print head assembly is fixedly mounted on a locking mechanism, which comprises a flange and a collet, wherein the collet has an inner circumference for slideably mounting on the shaft, and a tapered outer circumference having a first threaded section and a second threaded section. The flange has a threaded opening larger than the first threaded section but smaller than the second threaded section. When adjusting the position of the print head assembly, an operator turns the collet so that flange is engaged with the first threaded section. When locking the position of the print head assembly, the operator turns the collet so that the flange is engaged with the second threaded section, causing the collet to exert a frictional force on the shaft.

13 Claims, 6 Drawing Sheets

SHAFT LOCK DEVICE AND METHOD

FIELD OF THE INVENTION

The present invention relates generally to an addressing machine in a mass mailing system and, more particularly, to a locking mechanism for locking a print head assembly in the addressing machine.

BACKGROUND OF THE INVENTION

In a mass mailing system, an addressing machine having a plurality of print heads is typically used to print a mailing address on an envelope along with other printed items, such as the postage indicia, return address and promotional messages. Because the size of the envelope may vary, the print head in the addressing machine must be adjusted. Typically, the print heads are mounted on one or more shafts so that the position of the print heads can be adjusted along the longitudinal axis of the shaft, which is substantially perpendicular to the moving direction of the envelope.

As shown in FIG. 1, the addressing machine 1 comprises an envelope feeder 10 and a printing section 100. The envelope feeder 10 has a driving mechanism 16 for releasing one envelope 14 at a time from a stack 12 to the printing section 100. The printing section 100 has a driving mechanism 20 and a pair of pickup rollers 22 to move the released envelope 14 further along the moving direction 90. While the envelope 14 is moving along the moving direction 90, a plurality of print head assemblies 40 is used to print the printed items on the envelope 14.

A top view of the printing section 100 is shown in FIG. 2. As shown, the printing section 100 has a rack 200 for mounting a plurality of shaft mounts 210. The print head assemblies are mounted on a plurality of shafts 220, which are mounted on the shaft mounts 210. In order to adjust the print head assemblies 40 relative to the moving path 92 of the envelope 14, the print head assemblies 40 can be slid on the shafts 220. Once each of the print head assemblies 40 has been moved to a desired position, it is locked in that position so that the printed items on the envelope 40 can be printed in a designated area in a consistent fashion. Advantageously, the print head assembly 40 comprises a plurality of print heads fixedly mounted on a carriage 50, which is slideably mounted on the shaft 220.

Furthermore, a machine operator should be able to rotate the print head assemblies 40 upward, as shown in FIG. 3, to occasionally clean the print heads on the assemblies.

Thus, it is desirable and advantageous to provide a method and device for locking and unlocking the print head assemblies so that the position of the print head assemblies relative to the moving path of the envelope can be easily changed or adjusted. Furthermore, it is desirable and advantageous to have a reasonably small locking mechanism so that it will not interfere with the operator when the operator adjusts the position of the print head assemblies and when the operator lifts the print head assemblies for cleaning or other maintenance purposes.

SUMMARY OF THE INVENTION

It is a primary objective to the present invention to provide a method and mechanism for locking and unlocking a device for engagingly connecting a carriage to a shaft, such that when the device is unlocked, the carriage position along the shaft can be adjusted, and when the device is locked, the adjusted position is maintained. This objective can be achieved by engaging a collet having a tapered male pipe thread section with a flange having a matching female pipe thread section. The collet is fixedly attached to a thumb wheel or turn knob so that when the thumb wheel is turned to tighten the collet further into the flange, the collet is squeezed against the shaft, thereby restricting the collet, together with the flange, from moving along the longitudinal axis of the shaft. But when the thumb wheel is turned the other direction to loosen the collet from the flange, the collet and the flange can be slid along the shaft. As such, when the carriage is fixedly attached to the flange, its position can be adjusted or locked.

Thus, according to the first aspect of the present invention, there is provided a locking device for use in conjunction with a shaft, the locking device connected to a carriage, the shaft having a longitudinal axis, the locking device operable in an unlock position and a locked position. The locking device comprises:

- a collet having
  - a first end and a second end along the longitudinal axis of the shaft,
  - an inner circumference for slideably mounting on the shaft, and
  - an outer surface having a first threaded section adjacent to the first end and a second threaded section adjacent to the second end;
- means for connecting the locking device to the carriage; and
- a flange having a substantially circular opening with a threaded circumference for rotatably mounting over the outer surface of the collet, wherein the diameter of the circular opening is greater than at least a part of the first threaded section of the collet, and smaller than the diameter of at least a part of the second threaded section of collet, such that
- the locking device is in the locked position when the threaded circumference of the flange is engaged with the second threaded section of the collet, the flange causing the inner circumference of the collet to exert a frictional force against a section of the shaft, restricting the locking device and the carriage from moving along the longitudinal axis of the shaft, and
- the locking device is in the unlocked position when the threaded circumference of the flange is engaged with the first threaded section of the collet, the flange reducing the exerted frictional force against the shaft, allowing the locking device and the carriage to move along the longitudinal axis of the shaft.

The locking device further comprises a knob attached to the second end of the collet for turning the collet

- in a rotational direction about the longitudinal axis of the shaft to change the locking device from the locked position to the unlocked position, or
- in an opposite direction to change the locking device from the unlocked position to the locked position.

Preferably, the collet further includes a plurality of slits extending from the first end of the collet to at least part of the second threaded section, dividing at least a part of the collet into a plurality of circumferential sections, such that when the threaded circumference of the flange is engaged with the first threaded section of the collet in the unlocked position, the flange urges the circumferential sections to move toward the shaft for exerting the frictional force.

The carriage is used for mounting a print head assembly for printing a mailpiece moving in a moving path, and wherein the threaded circumference of the flange can be caused to engage with the first threaded section of the collet for adjusting the position of the print head assembly relative to the moving path based on the mailpiece, and the threaded circumference can be caused to engage with the second threaded section of the collet for maintaining the adjusted position of the print head assembly.

Advantageously, the collet has a coaxially extended section, the extended section having an outer circumference smaller than the diameter of the circular opening so as to allow the flange to be engaged with the threaded sections through the extended section, and an inner circumference substantially equal to the inner circumference of the collet such that when the threaded circumference of the flange is engaged with the second threaded section of the collet, the inner circumference of the extended section also exerts a frictional force against the shaft.

The flange is fixedly attached to the connecting means.

According to the second aspect of the present invention, there is provided a method for locking and unlocking a carriage engagingly connected to a shaft having a longitudinal axis. The method comprises the steps of:

1) providing a locking device, slideably mounting on the shaft, the locking device comprising:

a collet having a first end and a second end along the longitudinal axis of the shaft, an inner circumference for slideably amounted on the shaft, and an outer surface having a first threaded section adjacent to the first end and a second threaded section adjacent to the second end;

means for connecting the locking device to the carriage; and a flange having a substantially circular opening with a threaded circumference for rotatably mounting over the outer surface of the collet, wherein the diameter of the circular opening is greater than at least a part of the first threaded section of the collet, and smaller than the diameter of at least a part of the second threaded section of collet, such that when the threaded circumference of the flange is engaged with the second threaded section of the collet, the flange causes the inner circumference of the collet to exert a frictional force against a section of the shaft, thereby restricting the locking device from moving along the longitudinal axis of the shaft, and when the threaded circumference of the flange is engaged with the first threaded section of the collet, the flange reduces said frictional force; allowing the locking device to move along the longitudinal axis of the shaft;

2) causing the threaded circumference of the flange to engage with the first threaded section of the collet for adjusting the position of the carriage along the longitudinal axis of the shaft, and 3) causing the threaded circumference of the flange to engage with the second threaded section of the collet for maintaining the adjusted position of the carriage.

The second end of the collet is attached to a knob and wherein the knob can be turned in a rotational direction to cause the threaded circumference of the flange to engage with the second threaded section of the collet, and the knob can be turned in an opposite direction to cause the threaded circumference of the flange to engage with the first threaded section.

The rotational direction is a clockwise direction and the opposition direction is a counter-clockwise direction.

According to the third aspect of the present invention, there is provided an addressing machine having at least one print head assembly for printing a substantially flat item moving in a moving direction. The addressing machine comprising:

at least one shaft having a longitudinal axis, substantially perpendicular to the moving direction of the flat item;

a shaft mount for mounting the shaft; and a locking device comprising:

a collet having a first end and a second end along the longitudinal axis of the shaft, an inner circumference for slideably amounting on the shaft, and an outer surface having a first threaded section adjacent to the first end and a second threaded section adjacent to the second end;

means for connecting the locking device to the carriage; and a flange having a substantially circular opening with a threaded circumference for rotatably mounting over the outer surface of the collet, wherein the diameter of the circular opening is greater than at least a part of the first threaded section of the collet, and smaller than the diameter of at least a part of the second threaded section of collet, such that when the threaded circumference of the flange is engaged with the first threaded section of the collet, the locking device and the carriage can be moved along the longitudinal axis of the shaft for adjusting the position of the print head assembly relative to the moving direction of the flat item, and when the threaded circumference of the flange is engaged with the second threaded section of the collet in the locked position, the flange causes the inner circumference of the collet to exert a frictional force against a section of the shaft, restricting the locking device and the carriage from moving along the longitudinal axis of the shaft, thereby maintaining the adjusted position of the print head assembly.

The flat item can be an envelope, a sheet of paper or a mailpiece.

The present invention will become apparent upon reading the description taken in conjunction with FIGS. 1 to 7.

BEST MODE FOR CARRYING OUT THE INVENTION

Figure 1:
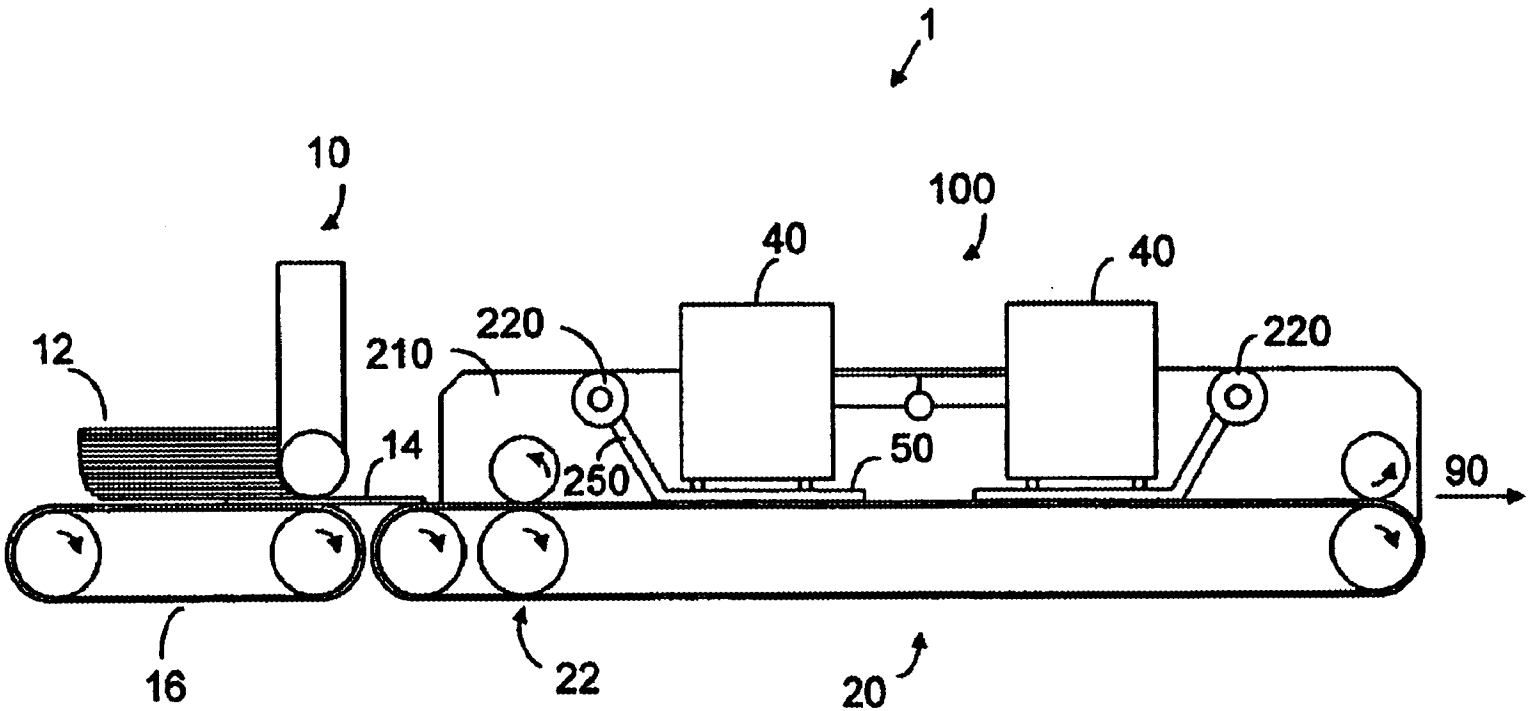
FIG. 1 is a schematic representation showing an addressing machine having a plurality of print head assemblies to print printed items on an envelope.
Figure 2:
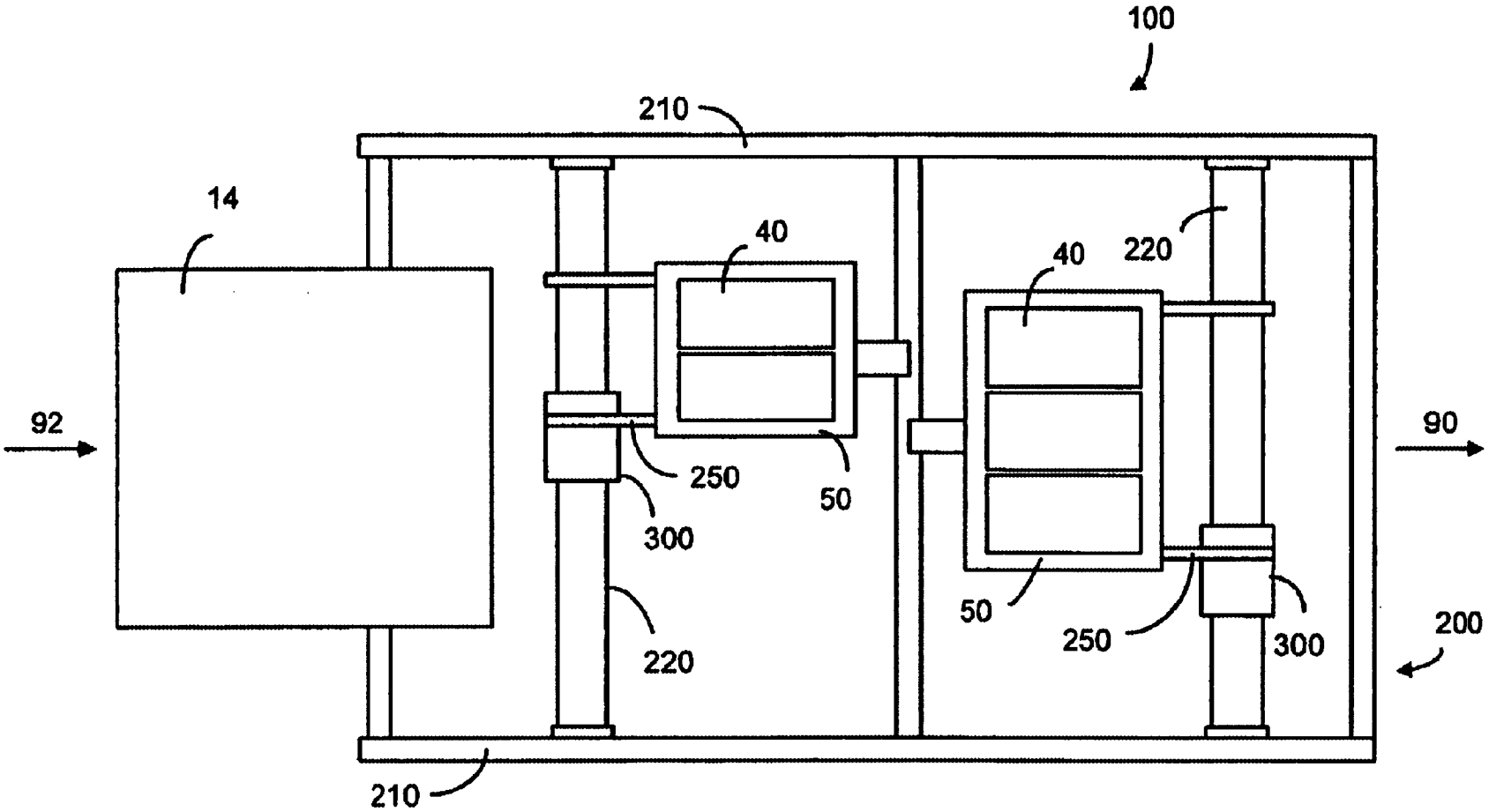
FIG. 2 is a schematic representation showing the top view of the printing section of the addressing machine.
Figure 3:
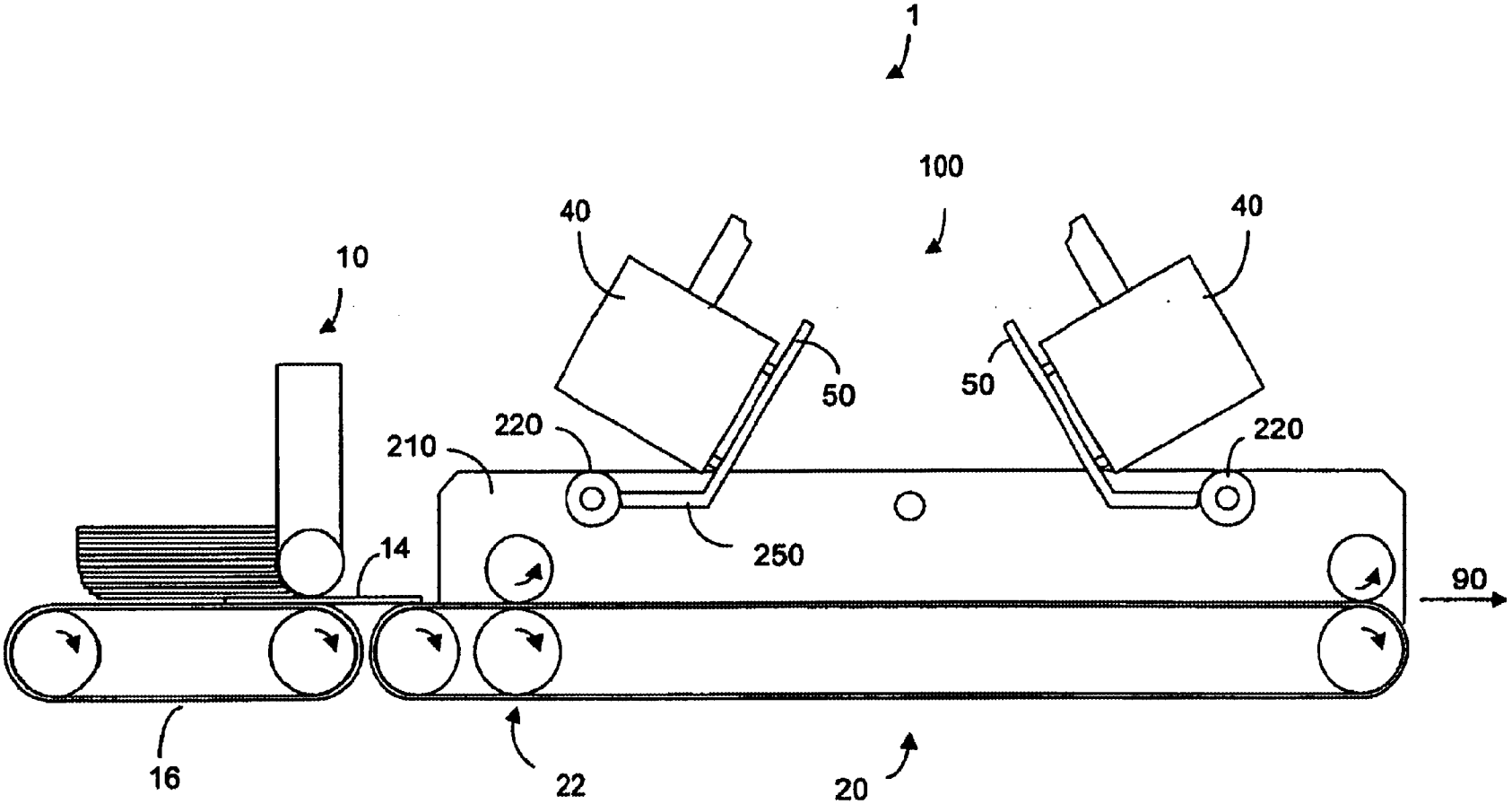
FIG. 3 is a schematic representation showing the print head assemblies are lifted upward for maintenance purposes.

FIG. 4 shows the locking device, according to the present invention and part of a carriage arm that is fixedly attached to the locking device. The carriage arm 250 is part of the carriage 50 for mounting the print heads in the print head assembly 40 (see FIG. 2). As shown in the figure, the locking device 300 comprises a collet 350 and a locking mechanism having the shape of a flange 310. The carriage arm is fixedly attached to the flange 310, such that when the locking device 300 is in an unlocked position, the carriage 50 is allowed to move along the longitudinal axis 222 of the shaft so that the position of the print head assembly 40 can be adjusted. But when the locking device 300 is in a locked position, the carriage is restricted from moving along the longitudinal axis 222, thereby maintaining the adjusted position of the print head assembly 40.

Figure 4A:
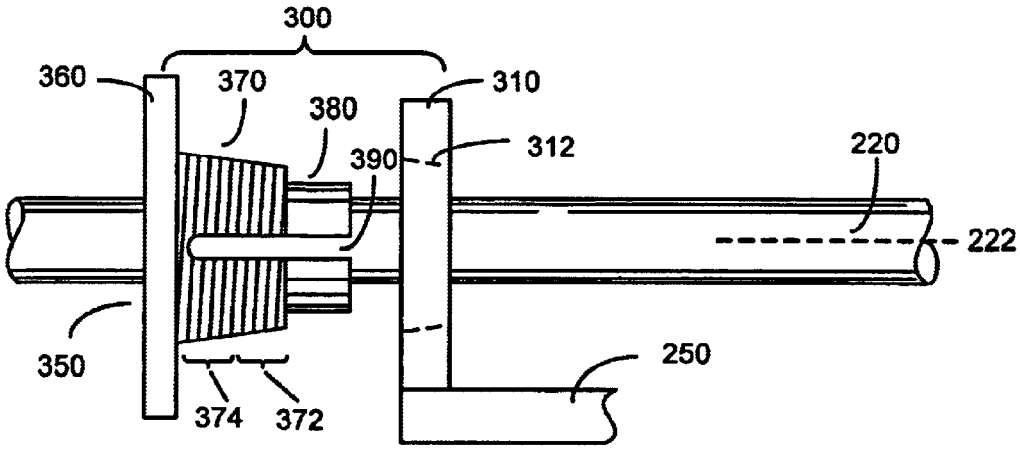
FIG. 4*a* is a side view showing the components in the locking device being disengaged from each other.
Figure 4B:
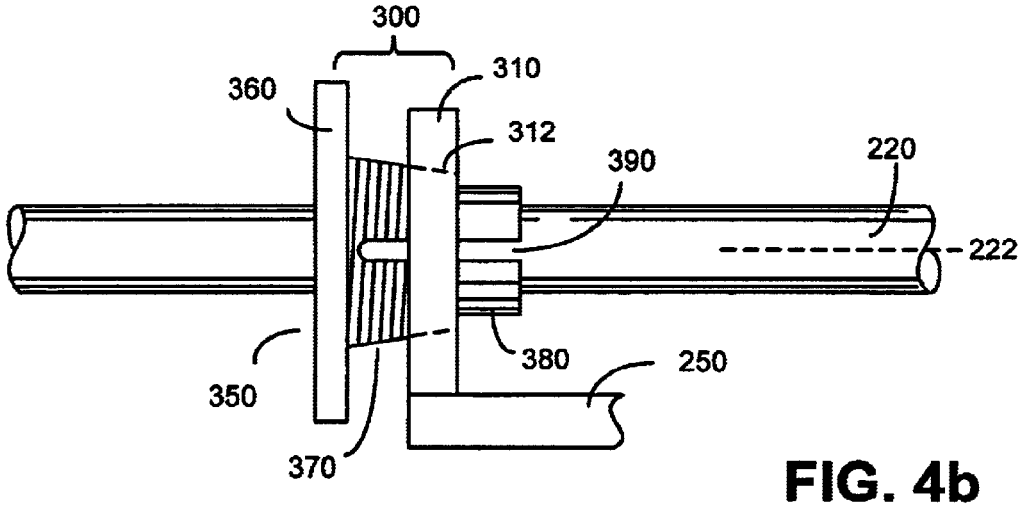
FIG. 4*b* is a side view showing the locking device in an unlocked position.
Figure 4C:
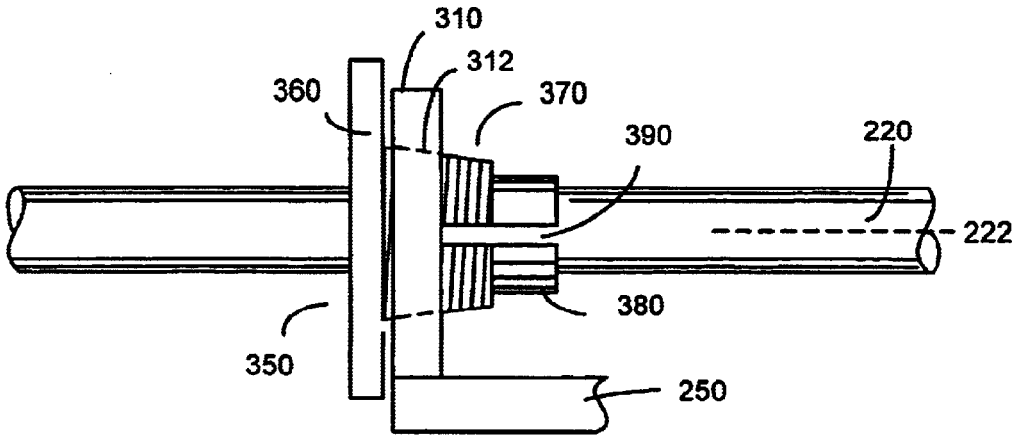
FIG. 4*c* is a side view showing the locking device in a locked position.

As shown in the figure, the collet 350 comprises a tapered male pipe thread section 370 and an extended section 380. The collet 350 has an inner circumference 382 (see FIG. 5*a*) slightly larger than the shaft's diameter so that the collet 350 can be slideably mounted on the shaft 220 for motion. The flange 310 has a sloped inner circumference 312 with a female pipe thread matching the tapered male pipe thread of the collet 350. The pipe thread section 370 is fixedly attached to a thumb wheel or turn knob 360 so that the thumb wheel 360 can be used to cause the male pipe thread on the collet 350 to engage with the female pipe thread on the flange 310, as shown in FIGS. 4*b* and 4*c*. As shown in FIG. 4*a*, the tapered male pipe thread section 370 has a first section 372 and a second section 374, with the diameter of the first section 372 being generally smaller than the diameter of the second section 374. At least two, but preferably four, slits 390 are provided on the tapered male pipe thread section 370 and the extended section 380 (see FIG. 6). These slits effectively divide the tapered pipe thread section 370 and the extended section 380 into a plurality of circumferential sections 378 (see FIG. 6).

When the first section 372 of the male pipe thread is engaged with the female pipe thread of the flange 310, as shown in FIG. 4*b*, the locking device 300, along with the carriage arm 250, can be freely moved along the longitudinal axis 222 of the shaft 220. However, the relative position between the collet 350 and the flange 310 is fixed unless the thumb wheel 360 is turned. As such, the carriage 50 and the print head assembly 40 (see FIG. 2) can be adjusted relative to the moving path 92 of the envelope 14.

When the thumb wheel 360 is used to tighten the collet 350 relative to the flange 310 such that the second section 374 of the male pipe thread is engaged with the female pipe thread of the flange 310, as shown in FIG. 4*c*, the inner circumference of the flange 310 causes the circumferential sections 378 (see FIG. 6) to move inward toward each other. As a result, the inner circumference 382 (see FIG. 5*a*) of the collet 310 is reduced and the collet 310 is squeezed against the shaft 220.

Figure 5A:
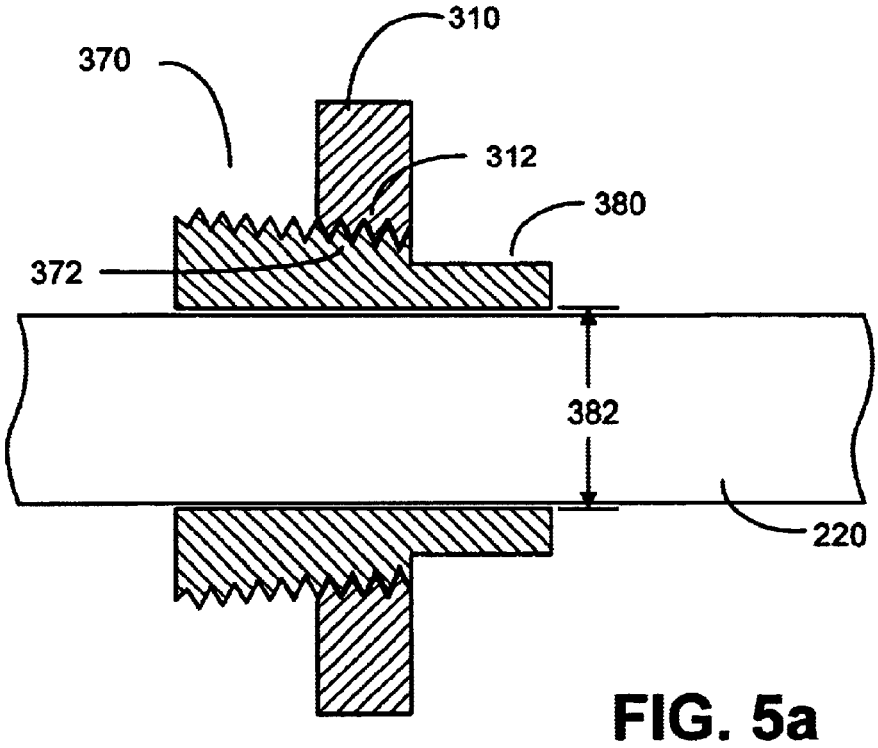
FIG. 5*a* is a cross sectional view showing the locking device in the unlocked position.
Figure 5B:
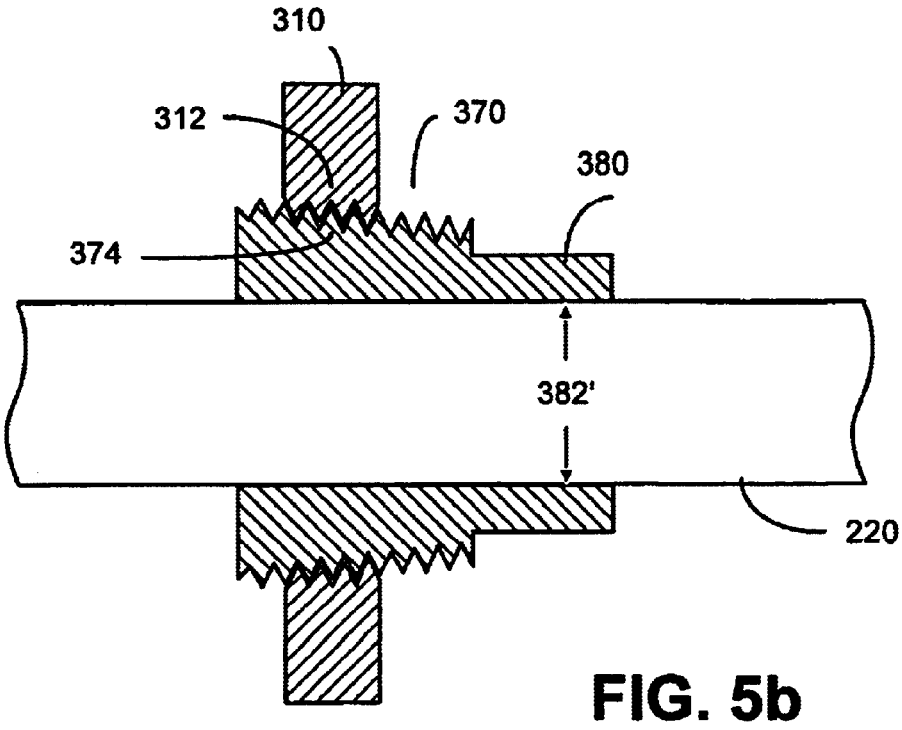
FIG. 5*b* is a cross sectional view showing the locking device in the locked position.

The engagement of the collet 350 and the flange 310 is further shown in the cross section views in FIGS. 5*a* and 5*b*. As shown in FIG. 5*a*, the first section 372 of the male pipe thread is engaged with the female pipe thread 312. As such, the inner diameter 382 of the collet 350 is slightly larger than the shaft's diameter. The locking device 300 is in the unlocked position. As shown in FIG. 5*b*, the second section 374 of the male pipe thread is engaged with the female pipe thread 312. The inner diameter 382' is in contact with the shaft's diameter, providing a frictional force between the collet 350 and the shaft 220. The locking device 300 is in the locked position. The extended section 380 is used to provide additional friction between the collet inner circumference 382 and the shaft 220.

Figure 6:
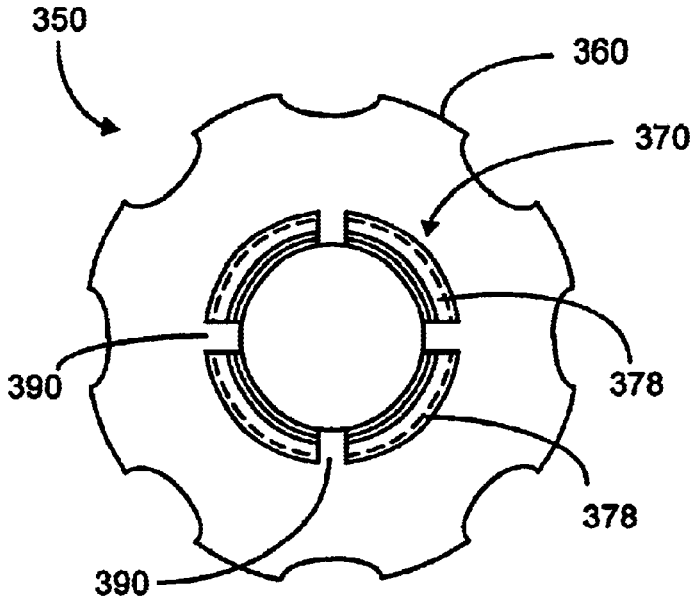
FIG. 6 is a front view of a collet showing the tapered male pipe thread section and the slits provided thereon.

FIG. 6 shows a front-view of the collet 350. As shown, the thumb wheel 360 has a plurality of indents on its outer circumference to facilitate the turning of the thumb wheel. As shown in the figure, four slits 390 are used to divide the male pipe thread section 370 and the extended section 380 into four circumferential sections 378. However, the number of slits 390 can also be two, three, five or more.

Figure 7:
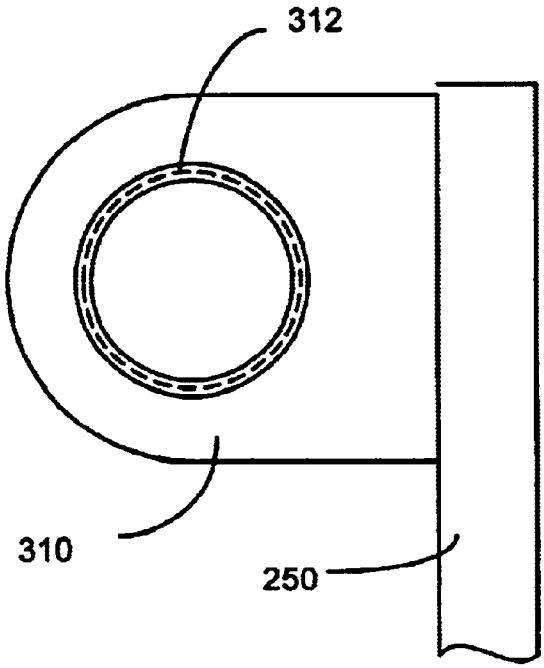
FIG. 7 is a front view of a flange showing the female pipe thread in the flange inner circumference and the carriage attached to the flange.

FIG. 7 shows the front view of the flange 310. As shown, the flange 310 is fixedly attached to the carriage arm 250 of the carriage 50.

When the position of print head 40 needs to be adjusted relative to the moving path 92 of the envelope 14, the operator can turn the thumb wheel 360 to loosen the collet 350 from the flange 310 to the unlocked position (see FIGS. 4*b* and 5*a*). As the friction between the collet 350 and the shaft 220 is reduced, the operator can move the print head 40 to a desired position.

When the print head assembly 40 is located at a desired position, the operator can use the turn the thumb wheel 360 in an opposite position to lock the print head assembly 40. Preferably, the thumb wheel 360 is turned in a clock-wise direction for putting the locking device 300 in the locked position.

The shaft 220 can be rotatably mounted on the shaft mount 210 (see FIG. 2), as such, the operator can lift the print head assembly 40 along with the locking device 300, without moving any part of the locking device 300.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A locking device for use in conjunction with a shaft, the locking device connected to a carriage, the shaft having a longitudinal axis, the locking device operable in an unlocked position and a locked position, said locking device comprising:

a collet having a first end and a second end along the longitudinal axis of the shaft, an inner circumference for slideably mounting on the shaft, and an outer surface having a first threaded section adjacent to the first end and a second threaded section adjacent to the second end;

means for connecting the locking device to the carriage; and a flange having a substantially circular opening with a threaded circumference for rotatably mounting over the outer surface of the collet, wherein the diameter of the circular opening is greater than at least a part of the first threaded section of the collet, and smaller than the diameter of at least a part of the second threaded section of collet, such that the locking device is in the locked position when the threaded circumference of the flange is engaged with the second threaded section of the collet, the flange causing the inner circumference of the collet to exert a frictional force against a section of the shaft, restricting the locking device and the carriage from moving along the longitudinal axis of the shaft, and the locking device is in the unlocked position when the threaded circumference of the flange is engaged with the first threaded section of the collet, the flange reducing the exerted frictional force against the shaft, allowing the locking device and the carriage to move along the longitudinal axis of the shaft.

2. The locking device of claim 1, further comprising a knob attached to the second end of the collet for turning the collet in a rotational direction about the longitudinal axis of the shaft to change the locking device from the locked position to the unlocked position, or in an opposite direction to change the locking device from the unlocked position to the locked position.

3. The locking device of claim 1, wherein the collet further includes a plurality of slits extending from the first end of the collet to at least part of the second threaded section, dividing at least a part of the collet into a plurality of circumferential sections, such that when the threaded circumference of the flange is engaged with the first threaded section of the collet in the unlocked position, the flange urges the circumferential sections to move toward the shaft for exerting the frictional force.

4. The locking device of claim 1, wherein the carriage is used for mounting a print head assembly for printing a mailpiece moving in a moving path, and wherein the threaded circumference of the flange can be caused to engage with the first threaded section of the collet for adjusting the position of the print head assembly relative to the moving path based on the mailpiece, and the threaded circumference can be caused to engage with the second threaded section of the collet for maintaining the adjusted position of the print head assembly.

5. The locking device of claim 1, wherein the collet has a coaxially extended section, the extended section having an outer circumference smaller than the diameter of the circular opening so as to allow the flange to be engaged with the threaded sections through the extended section, and an inner circumference substantially equal to the inner circumference of the collet such that when the threaded circumference of the flange is engaged with the second threaded section of the collet, the inner circumference of the extended section also exerts a frictional force against the shaft.

6. The locking device of claim 1, wherein the flange is fixedly attached to the connecting means.

7. A method for locking and unlocking a carriage engagingly connected to a shaft having a longitudinal axis, said method comprising the steps of:

1) providing a locking device, slideably mounting on the shaft, the locking device comprising:

a collet having a first end and a second end along the longitudinal axis of the shaft, an inner circumference for slideably mounting the shaft, and an outer surface having a first threaded section adjacent to the first end and a second threaded section adjacent to the second end;

means for connecting the locking device to the carriage; and a flange having a substantially circular opening with a threaded circumference for rotatably mounting over the outer surface of the collet, wherein the diameter of the circular opening is greater than at least a part of the first threaded section of the collet, and smaller than the diameter of at least a part of the second threaded section of collet, such that when the threaded circumference of the flange is engaged with the second threaded section of the collet, the flange causes the inner circumference of the collet to exert a frictional force against a section of the shaft, thereby restricting the locking device from moving along the longitudinal axis of the shaft, and when the threaded circumference of the flange is engaged with the first threaded section of the collet, the flange reduces said frictional force; allowing the locking device to move along the longitudinal axis of the shaft;

2) causing the threaded circumference of the flange to engage with the first threaded section of the collet for adjusting the position of the carriage along the longitudinal axis of the shaft, and 3) causing the threaded circumference of the flange to engage with the second threaded section of the collet for maintaining the adjusted position of the carriage.

8. The method of claim 7, wherein the second end of the collet is attached to a knob and wherein the knob can be turned in a rotational direction to cause the threaded circumference of the flange to engage with the second threaded section of the collet, and the knob can be turned in an opposite direction to cause the threaded circumference of the flange to engage with the first threaded section.

9. The method of claim 8, wherein the rotational direction is a clockwise direction and the opposition direction is a counter-clockwise direction.

10. An addressing machine having at least one print head assembly for printing a substantially flat item moving in a moving direction, said addressing machine comprising:

at least one shaft having a longitudinal axis, substantially perpendicular to the moving direction of the flat item;

a shaft mount for mounting the shaft; and a locking device comprising:

a collet having a first end and a second end along the longitudinal axis of the shaft, an inner circumference for slideably amounting on the shaft, and an outer surface having a first threaded section adjacent to the first end and a second threaded section adjacent to the second end;

means for connecting the locking device to the carriage; and a flange having a substantially circular opening with a threaded circumference for rotatably mounting over the outer surface of the collet, wherein the diameter of the circular opening is greater than at least a part of the first threaded section of the collet, and smaller than the diameter of at least a part of the second threaded section of collet, such that when the threaded circumference of the flange is engaged with the first threaded section of the collet, the locking device and the carriage can be moved along the longitudinal axis of the shaft for adjusting the position of the print head assembly relative to the moving direction of the flat item, and when the threaded circumference of the flange is engaged with the second threaded section of the collet in the locked position, the flange causes the inner circumference of the collet to exert a frictional force against a section of the shaft, restricting the locking device and the carriage from moving along the longitudinal axis of the shaft, thereby maintaining the adjusted position of the print head assembly.

11. The addressing machine of claim 10, wherein the flat item comprises an envelope.

12. The addressing machine of claim 10, wherein the flat item comprises a sheet of paper.

13. The addressing machine of claim 10, wherein the flat item comprises a mailpiece.

* * * * *